US006200099B1

(12) United States Patent
Liao

(10) Patent No.: US 6,200,099 B1
(45) Date of Patent: Mar. 13, 2001

(54) COMBINATION OF A CEILING FAN FRAME AND A MOTOR CASING

(76) Inventor: Ming Hang Liao, No. 11, Lane 94, Tong-Shin Rd., Shi-Tune District, Taichung (TW)

( * ) Notice: Subject to any disclaimer, the term of this patent is extended or adjusted under 35 U.S.C. 154(b) by 0 days.

(21) Appl. No.: 09/378,789

(22) Filed: Aug. 23, 1999

(51) Int. Cl.[7] ..... F01D 25/24
(52) U.S. Cl. ..... 416/244 R; 416/5; 248/343
(58) Field of Search ..... 416/5, 170 C, 416/170 R, 244 R, 246; 248/327, 342, 343, 344; 362/96

(56) References Cited

U.S. PATENT DOCUMENTS 4,428,032 * 1/1984 Workman ..... 362/96
5,034,869 * 7/1991 Choi ..... 362/363
6,027,310 * 2/2000 Kerr, Jr. et al. ..... 416/210 R
6,042,072 * 3/2000 Chi-Nan ..... 248/343
6,062,816 * 5/2000 Chang ..... 416/5

* cited by examiner

*Primary Examiner*—Edward K. Look
*Assistant Examiner*—Liam M McDowell
(74) *Attorney, Agent, or Firm*—Alan Kamrath; Rider Bennett Egan & Arundel, LLP.

(57) ABSTRACT

A motor casing of a ceiling fan has two pairs of lugs extending radially inward from the periphery thereof and the motor casing encloses the motor of the ceiling fan. A frame fixedly connected to a ceiling and has a flange to which two positioning devices are connected. Each positioning device has two support portions extending radially inward therefrom and each support portion has a slot. A resilient member connected to each support portion and is engaged between the two lugs corresponding to the positioning device so that the assembler can easily connect the motor casing and the frame without using bolts.

4 Claims, 6 Drawing Sheets

COMBINATION OF A CEILING FAN FRAME AND A MOTOR CASING

FIELD OF THE INVENTION

The present invention relates to a ceiling fan frame and a motor casing which has two pairs of lugs and the frame has a resilient member to be engaged between the two lugs so that the assembler can connect the frame and the casing quickly.

BACKGROUND OF THE INVENTION

Referring to FIG. 1, a conventional ceiling fan includes a frame 20 to be fixedly connected to the ceiling 70 by bolts 40 and a motor 10 is connected to the frame 20. A motor casing 30 is mounted to the motor 10 and connected to the frame 20. The frame 20 has an upward flange 90 through which a plurality of holes 60 are defined. The motor casing 30 has a plurality of apertures 50 defined in the wall thereof so that when connecting the motor casing 30 to the frame 20, the assembler has to lift the motor casing 30 and aligns the apertures 50 in the motor casing 30 with the holes 60 in the flange 90 of the frame 90 so that the assembler can insert the bolts 400 through the apertures 50 and the holes 60. However, the assembler has to pay a hard effort to maintain the motor casing 30 in the air to align the apertures 50 and the holes 60. Furthermore, there is a narrow space between the ceiling 70 and the frame 20 so that it is difficult for the assembler to tighten the bolts 400.

The present invention intends to provide a frame and a motor casing wherein the motor casing is easily and quickly connected to the frame so that the assembler does not need to hold the motor casing in the air. This allows the assembling time to be reduced and the assembling work is simplified.

SUMMARY OF THE INVENTION

In accordance with one aspect of the present invention, a combination of a ceiling fan frame and a motor casing is provided and the motor casing has two pairs of lugs extending radially inward from the periphery thereof. The frame has a flange to which two positioning means are connected. Each positioning means has a resilient member which is engaged between the two lugs corresponding to the positioning means so that the motor casing is connected to the frame within a short period of time.

The main object of the present invention is to provide a combination of a ceiling fan frame and a motor casing wherein the motor casing is connected to the frame without using a bolt so as to save much assembling time.

Another object of the present invention is to provide a combination of a ceiling fan frame and a motor casing wherein the motor casing is connected to the frame by a triangular resilient member.

Further objects, advantages, and features of the present invention will become apparent from the following detailed description with appropriate reference to the accompanying drawings.

DETAILED DESCRIPTION OF THE PREFERRED EMBODIMENT

Referring to FIGS. 2 to 5, the motor casing 30 of the present invention comprises a having a circular wall with an open top and a bottom through which the shaft of the motor 10 extends. Two pairs of lugs 80 extend radially inward from the periphery of the motor casing 30 so that a gap 81 is defined between the two lugs 80.

Figure 1:
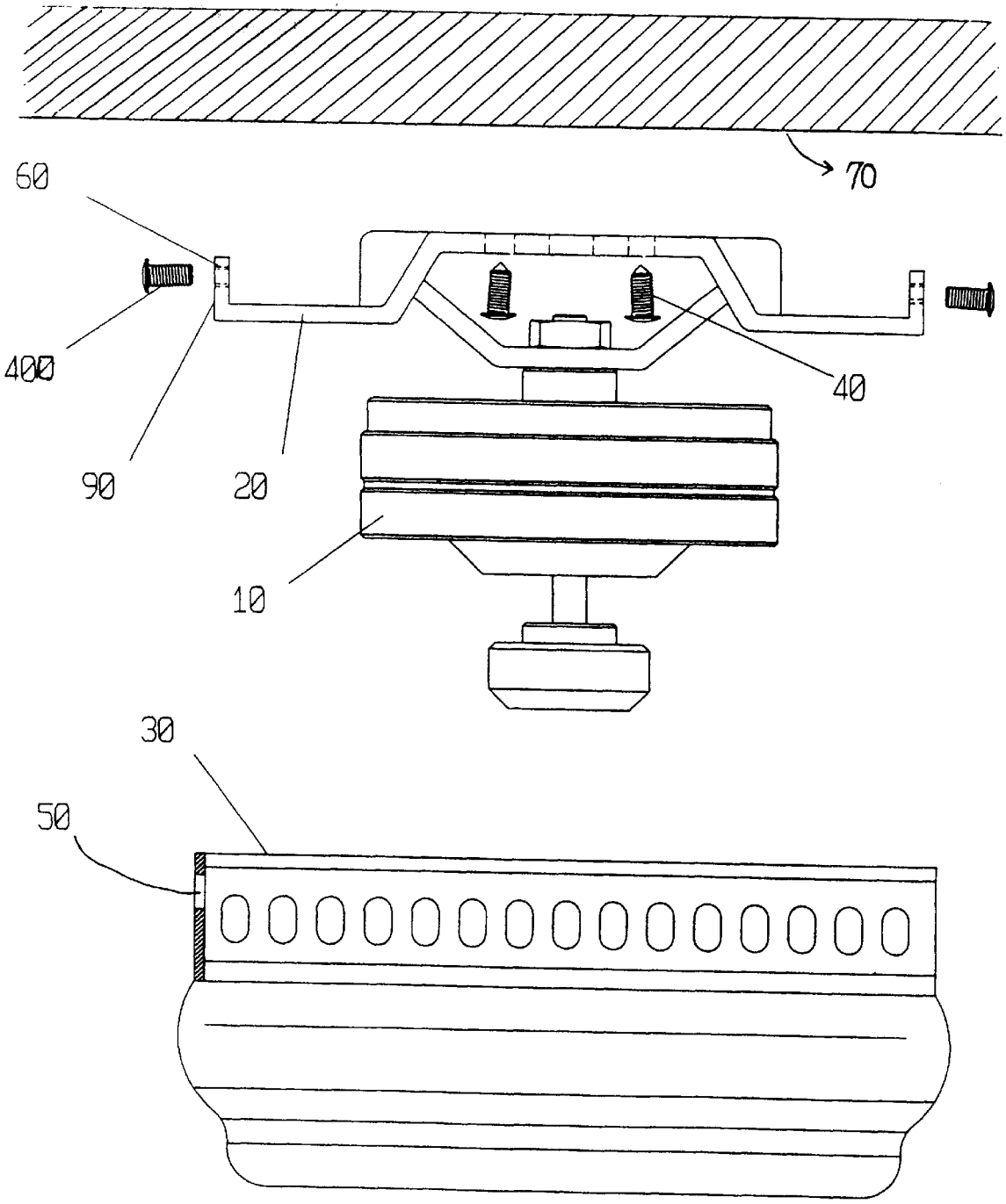
FIG.1 PRIOR ART
FIG. 1 is an exploded view of a conventional motor casing and a conventional ceiling fan frame.
Figure 2:
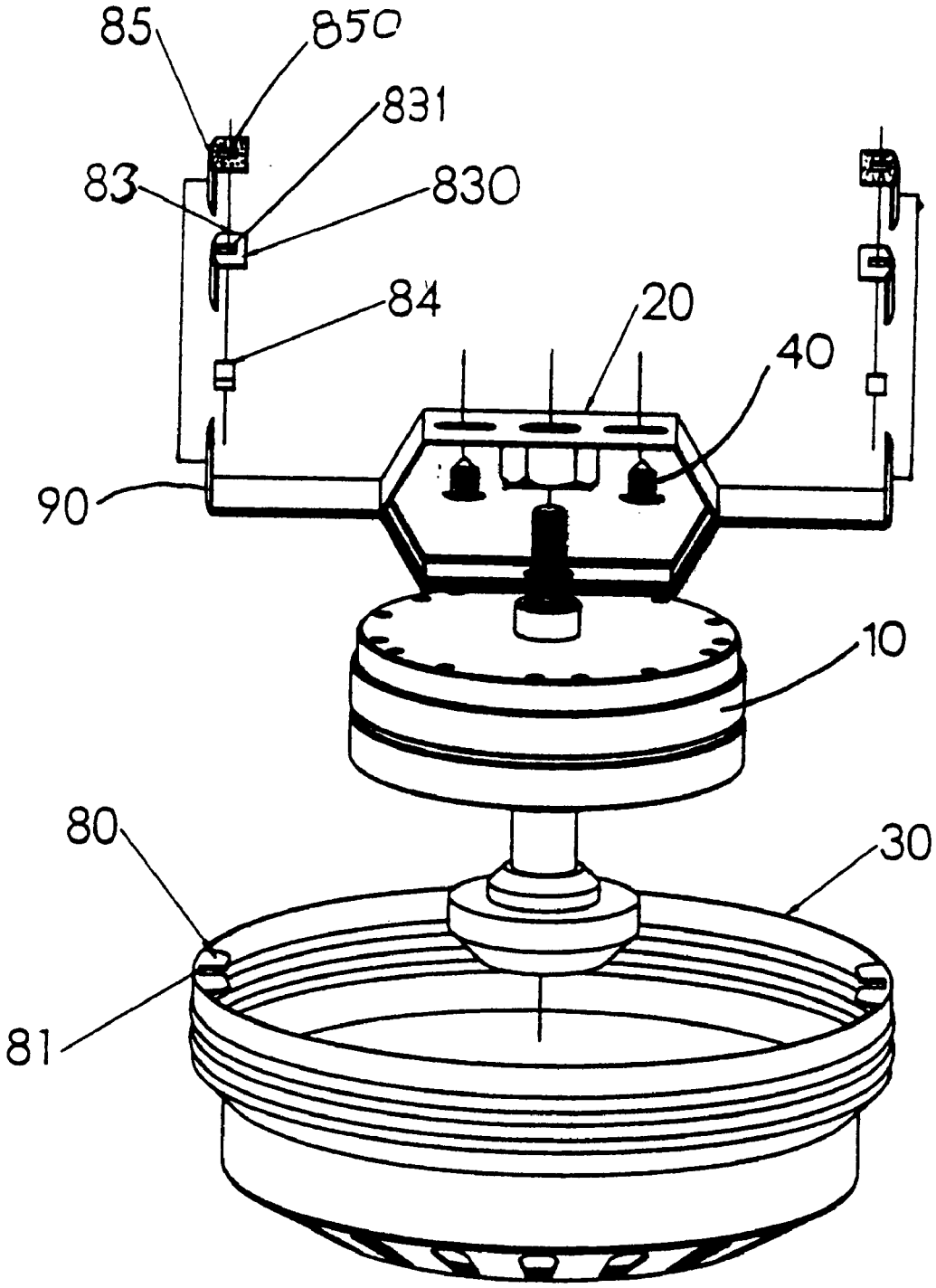
FIG. 2 is an exploded view of a motor casing and a ceiling fan frame in accordance with the present invention.
Figure 3:
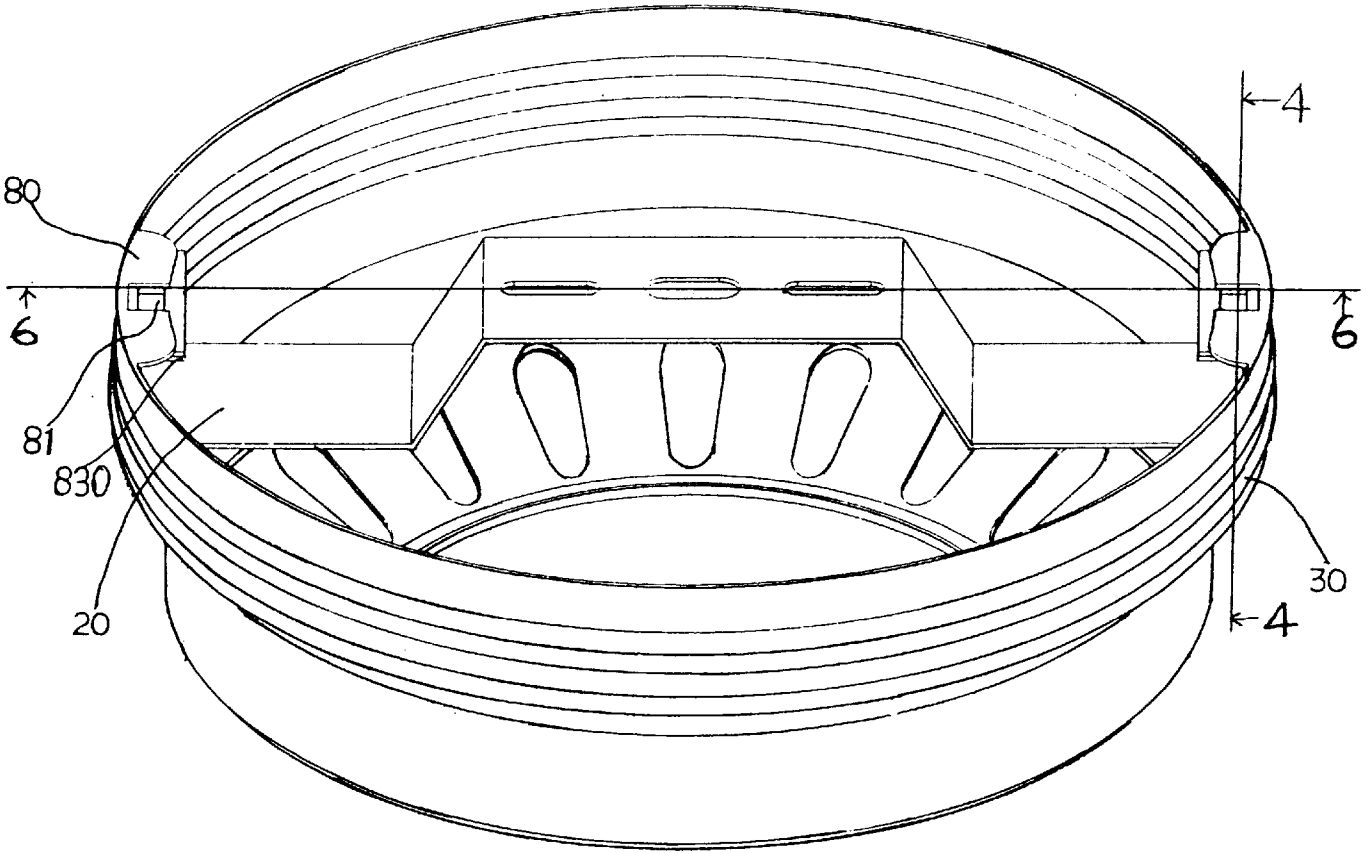
FIG. 3 is a perspective view of the combination of the motor casing and the ceiling fan frame in accordance with the present invention.
Figure 4:
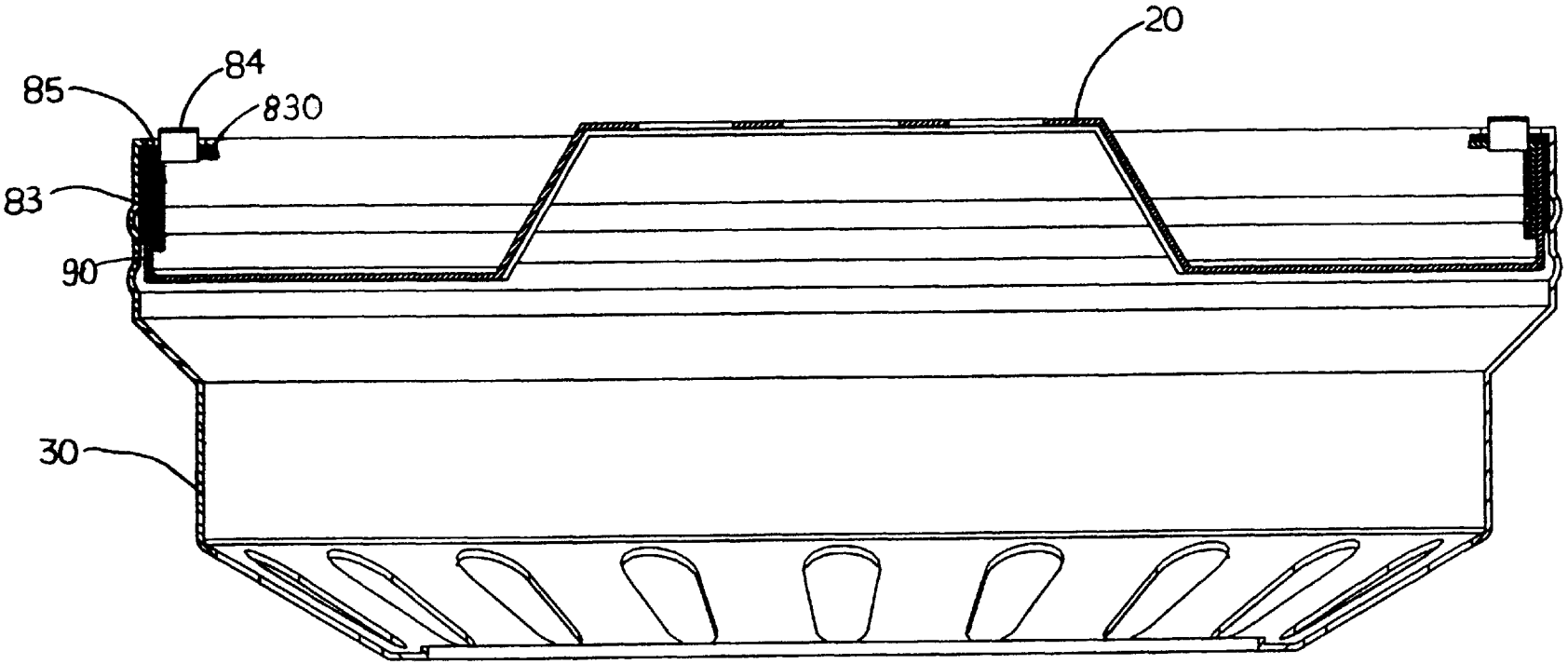
FIG. 4 is a side elevational view, partly in section, of the combination of the motor casing and the ceiling fan frame in accordance with the present invention.
Figure 5:
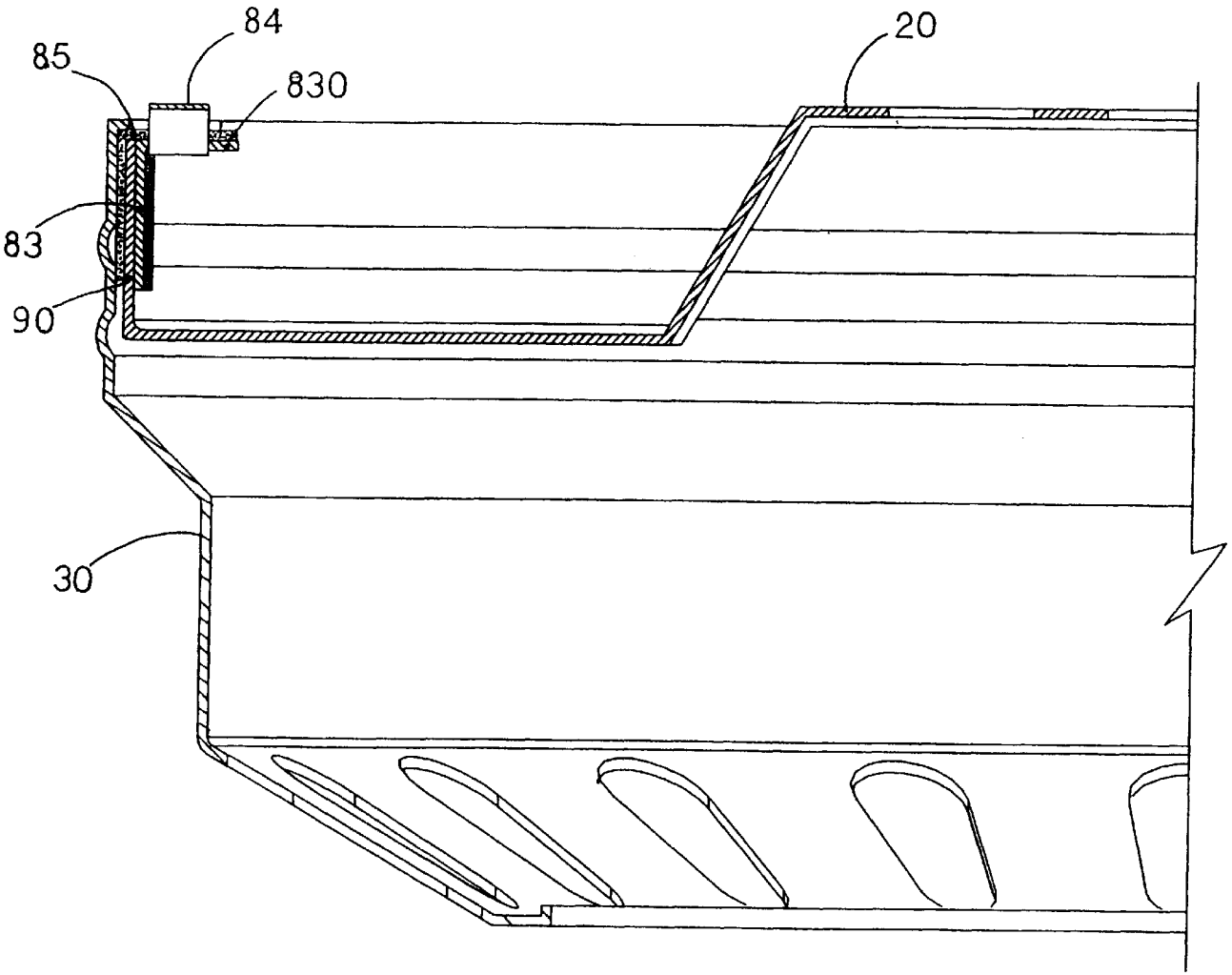
FIG. 5 is An enlarged side elevational view, partly in section, of the combination of the motor casing and the ceiling fan frame in accordance with the present invention.
Figure 6:
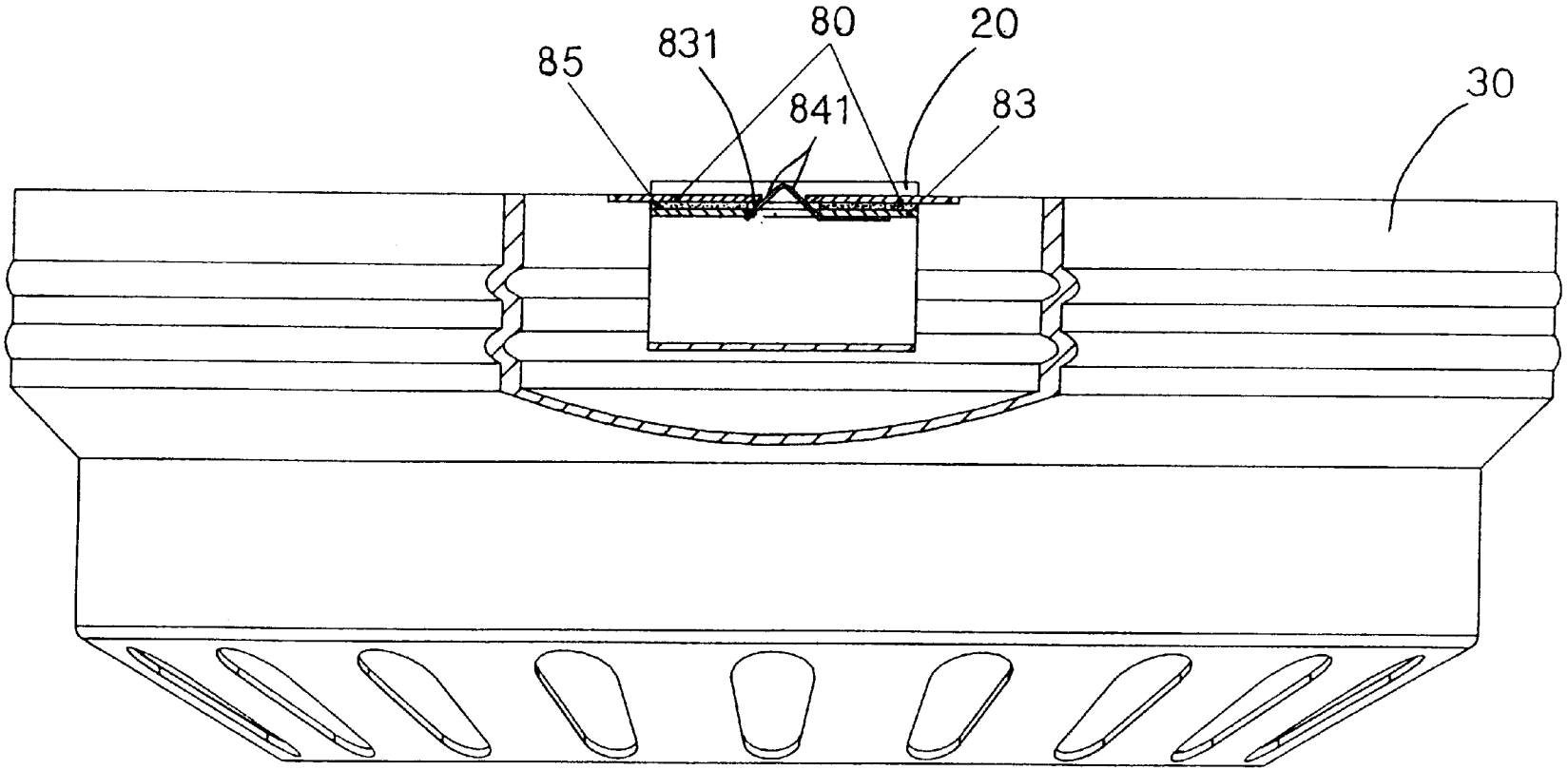
FIG. 6 is a side elevational view, partly in section, to show the triangular resilient member engaged between the two lugs of the motor casing of the present invention.

The frame has a central portion 20 and two flanges 90 extend from the central portion 20. The central portion 20 is fixedly connected to a ceiling by bolts 40 and each flange 90 has a positioning means connected thereto. Each positioning means has a base plate 83 connected to the flange 90 of the frame and the base plate 83 has a support portion 830 extending radially inward therefrom. A first slot 831 is defined in the support portion 830 so that the resilient member 84 is engaged with the first slot 831. Referring to FIG. 6, the resilient member 84 includes a triangular protrusion comprising two inclined sides 841, the triangular protrusion extending from the first slot 831. Each base plate 83 has a pad 85 connected to the support portion 830 thereof and the pad 85 has a second slot 850 defined therethrough. The first slot 831 is located in alignment with the second slot 850.

When assembling the motor casing 30 to the motor 10, the two lugs 80 are overlapped on the pads 85 and the two inclined sides 841 of the resilient member 84 are engaged with the gap 81 between the two lugs 80.

Accordingly, the assembler simply holds the motor casing 30 toward the motor 10 to let the resilient members 84 respectively engaged with the gaps 81 respectively defined between the two pairs of lugs 80. The motor casing 30 is then quickly and easily connected to the frame without using a bolt. This reduces much of assembling time for the assemblers.

The invention is not limited to the above embodiment but various modification thereof may be made. It will be understood by those skilled in the art that various changes in form and detail may made without departing from the scope and spirit of the present invention.

What is claimed is:

1. A combination of a ceiling fan frame and a motor casing, said motor casing having two pairs of lugs extending radially inward from the periphery thereof, and said frame having a flange and two positioning means connected to said flange, each positioning means having a resilient member which is engaged between said two lugs corresponding to said positioning means.

2. The combination as claimed in claim 1, wherein each positioning means has a base plate connected to said flange of said frame and said base plate has a support portion extending radially inward therefrom, a first slot defined in said support portion so that said resilient member is engaged with said slot.

3. The combination as claimed in claim 1, wherein each base plate has a pad connected to said support portion thereof and said pad has a second slot defined therethrough, said first slot located in alignment with said second slot.

4. The combination as claimed in claim 1, wherein said resilient member includes a triangular protrusion comprising two inclined sides, said two inclined sides engaged between said two lugs.

* * * * *